US011636966B1

(12) United States Patent
Fitzhugh

(10) Patent No.: US 11,636,966 B1
(45) Date of Patent: Apr. 25, 2023

(54) SYSTEM AND DEVICE FOR HANGING MAGNETIC ORNAMENTS

(71) Applicant: Anne Ken-Chu Fitzhugh, San Marino, CA (US)

(72) Inventor: Anne Ken-Chu Fitzhugh, San Marino, CA (US)

( * ) Notice: Subject to any disclaimer, the term of this patent is extended or adjusted under 35 U.S.C. 154(b) by 29 days.

(21) Appl. No.: 17/499,577

(22) Filed: Oct. 12, 2021

(51) Int. Cl.
*H01F 7/02* (2006.01)
*A47G 33/08* (2006.01)

(52) U.S. Cl.
CPC ..... *H01F 7/0205* (2013.01); *A47G 33/08* (2013.01)

(58) Field of Classification Search
CPC ..... H01F 7/0205; A47G 33/08
See application file for complete search history.

(56) References Cited

U.S. PATENT DOCUMENTS 4,835,024 A 5/1989 Hallay
7,217,014 B2 5/2007 Nielson
7,640,636 B2 1/2010 Clark
7,806,568 B2 10/2010 Nielson
9,392,848 B2 7/2016 LeBlanc
10,595,659 B2 3/2020 Milkowski
2011/0219587 A1* 9/2011 Nizan ..... A41D 27/08 24/303
2012/0015120 A1 1/2012 Haegele et al.

FOREIGN PATENT DOCUMENTS

JP 3070702 U * 8/2000

* cited by examiner

*Primary Examiner* — Mohamad A Musleh

(74) *Attorney, Agent, or Firm* — Olav M. Underdal; IDP Patent Services

(57) ABSTRACT

A magnetic ornament system includes: a mounting structure with a mounting surface; a magnetic plate, including a plate body, an adhesive material, and a protective member; and a magnetic ornament, including a magnet, a connector member, and an ornament assembly; such that the magnetic plate is positionable on the mounting surface of the mounting structure, such that the magnetic ornament is detachably connectable to the magnetic plate.

21 Claims, 9 Drawing Sheets

Magnetic Ornament System

Magnetic Plate

SYSTEM AND DEVICE FOR HANGING MAGNETIC ORNAMENTS

CROSS-REFERENCE TO RELATED APPLICATIONS

N/A.

FIELD OF THE INVENTION

The present invention relates generally to the field of decoration systems and methods, and more particularly to methods and systems for hanging ornament systems.

BACKGROUND OF THE INVENTION

Hanging ornament systems are prevalent as a means of customizable decoration for commercial, residential, and recreational use.

However, such systems are typically tedious to assemble and customize, and may be difficult to attach to a suitable mounting structure.

As such, considering the foregoing, it may be appreciated that there continues to be a need for novel and improved devices and methods for hanging ornament systems.

SUMMARY OF THE INVENTION

The foregoing needs are met, to a great extent, by the present invention, wherein in aspects of this invention, enhancements are provided to the existing model of hanging ornament systems.

In the following, we describe the structure of an aspect of a system for hanging magnetic ornaments.

In an aspect of a magnetic ornament system for hanging magnetic ornaments can include:

a) a mounting structure which can include:
   i. a main body; and
   ii. a mounting surface which can occupy an area of the main body; and b) a magnetic plate, which can include:
   i. a plate body, which can be made of a ferromagnetic or ferrimagnetic material, and wherein the plate body can be rigid or flexible;
   ii. an adhesive material, which can be a structural adhesive (i.e., permanent and non-detachable) or a pressure sensitive adhesive; and
   iii. a protective member, which can be a protective film;
   such that the protective member can be positioned on the top surface of the adhesive material;
   such that the adhesive material can be positioned on the top surface of the plate body; and c) a magnetic ornament, which can include:
   i. a magnet;
   ii. a connector member, which can be connected to a bottom of the magnet, wherein the connector member can be a hoop hanger; and
   iii. an ornament assembly, which can include at least one hanging ornament or a plurality of hanging ornaments, wherein the top end of the ornament assembly can connect to the connector member of the magnetic ornament;

such that the magnetic plate can be positioned to adhere to the mounting surface of the mounting structure, using an adhesive;

wherein the magnet is detachably connectable to the plate body of the magnetic plate;

such that the magnetic ornament is detachably connectable to the magnetic plate.

In related aspects, the adhesive material can be a structural adhesive, such that the magnetic plate is permanently connectable to the mounting surface of the mounting structure.

In a related aspect, the magnetic plate can be made of a ferromagnetic material.

In another related aspect, the magnetic plate can be made of a ferrimagnetic material.

In yet another related aspect, the connector member can be a hoop hanger, snap connector, clasp, hook-and-loop fastener, pin, or other mechanical fastener.

In a related aspect, the plate body can be comprised of a thin, flexible sheet of ferromagnetic or ferrimagnetic material embedded between a more ductile or elastic material.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
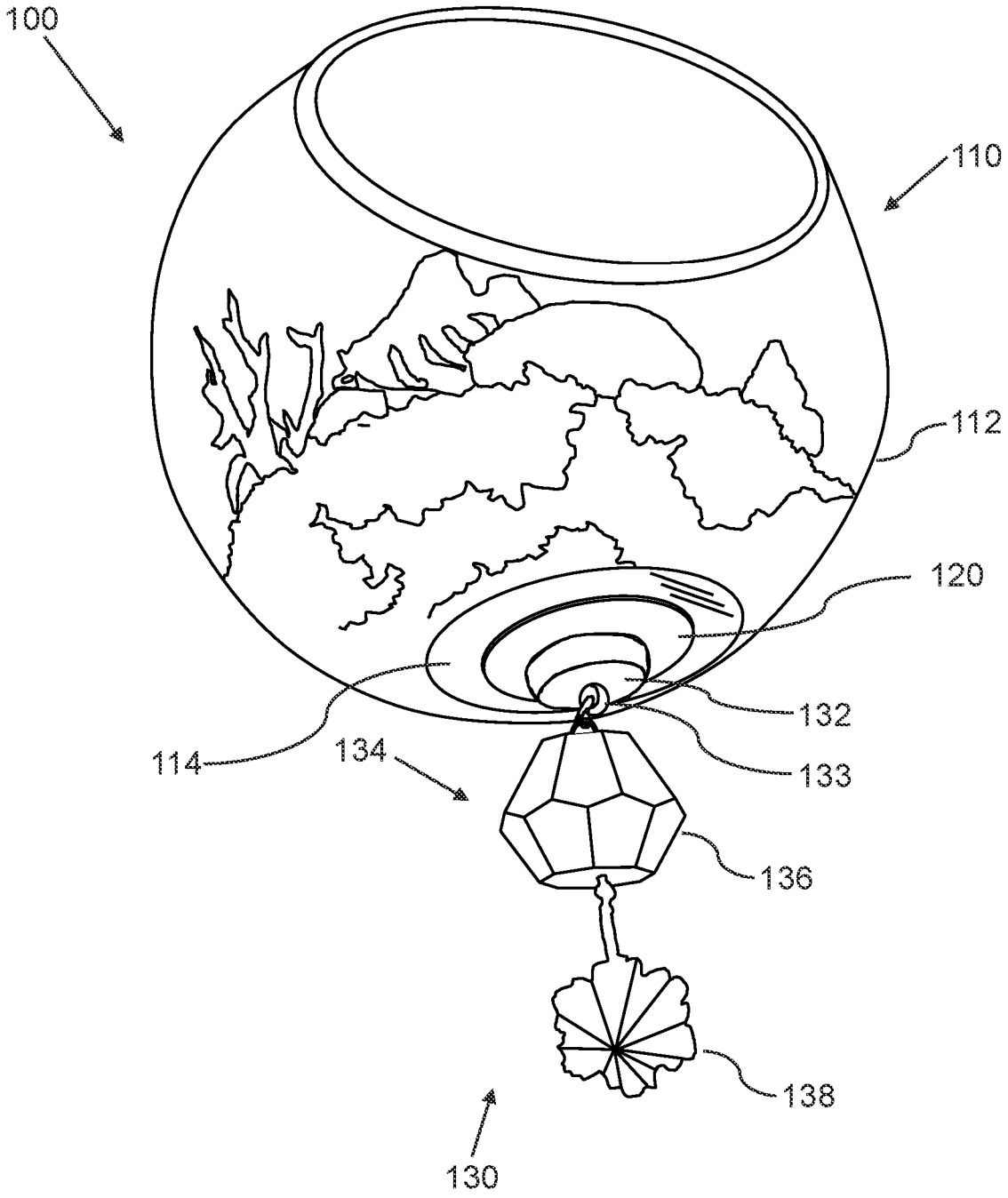
FIG. 1 is a bottom perspective view of a magnetic ornament system, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a magnetic ornament system 100 for hanging magnetic ornaments 130, with reference to FIGS. 1,2A, and 2B in such manner that like reference numerals refer to like components throughout; a convention that we shall employ for the remainder of this specification.

In an embodiment, as shown in FIGS. 1, 2A, 2B, and 2C, a magnetic ornament system 100, 200 for hanging magnetic ornaments 130 can include:

a) a mounting structure 110, 510, as shown in FIGS. 1,2A, 2B, 2C, and 5, which can include:
   i. a main body 112, 512, which for example can be transparent, translucent, or opaque; and can for example be configured as a hollow container with an exterior opening, or can be a solid object; and
   ii. a mounting surface 114, 214, 514 which for example can be configured to be either a flat surface 114 or a surface with a non-flat curvature, such that the mounting surface 114, 214 can occupy a surface area of the main body 112; and b) a magnetic plate 120 as shown in FIGS. 3A, 3B, 3C, 4A-4B, and 5, which can include:
   i. a plate body 122, which can be made of a ferromagnetic or ferrimagnetic material, and wherein the plate body 122 can be rigid or flexible;
   ii. an adhesive material 124, which can be a structural adhesive (i.e., permanent and non-detachable) or a pressure sensitive adhesive 124; and
   iii. a protective member 126, which can be a protective film 126, wherein the protective member 126 can be transparent, translucent, or opaque;
   such that the protective member 126 can be positioned on the top surface of the adhesive material 124;
   such that the adhesive material 124 can be positioned on the top surface of the plate body 122; and c) a magnetic ornament 130, 530 which can include:
   i. a magnet 132, 532, which can be a ceramic magnet made from strontium ferrite, barium ferrite, or some other magnetic ceramic;
   ii. a connector member 133, which can be connected to a bottom of the magnet 132, wherein the connector member 133 can be a hoop hanger; and
   iii. an ornament assembly 134, 534 which can include at least one hanging ornament 136, 138 or a plurality of hanging ornaments 136, 138, wherein the top end of the ornament assembly 134 can connect to the connector member 133 of the magnetic ornament 130;
   such that the magnetic plate 120 can be positioned to adhere to the mounting surface 114, 214 of the mounting structure 110, using an adhesive material 124, such that the magnetic plate 120 is held in position by the adhesive material 124;
   wherein the magnet is detachably connectable to the plate body of the magnetic plate;
   such that the magnetic ornament is detachably connectable to the magnetic plate.

Figure 2A:
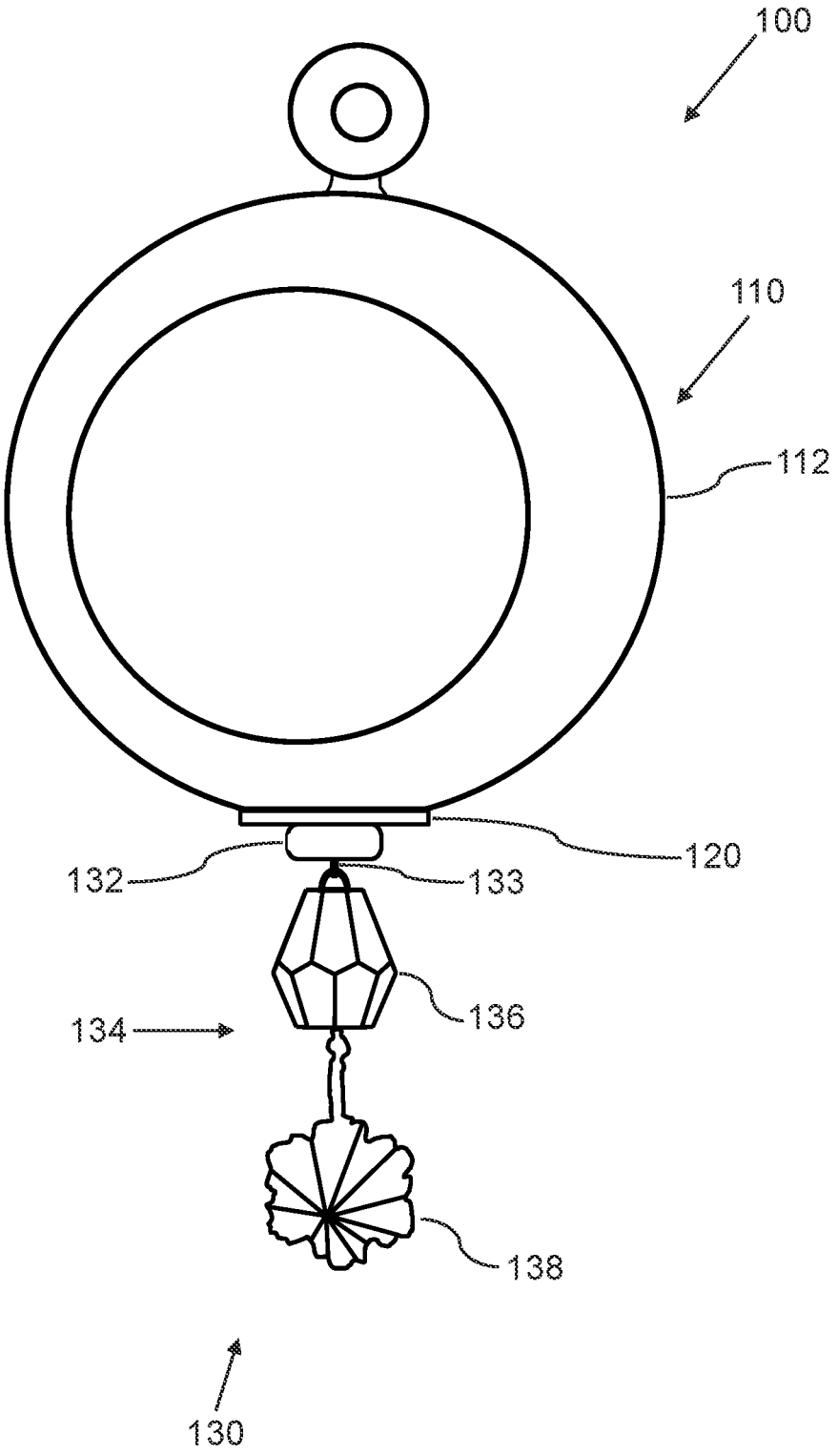
FIG. 2A is a front view of a magnetic ornament system, according to an embodiment of the invention.
Figure 2B:
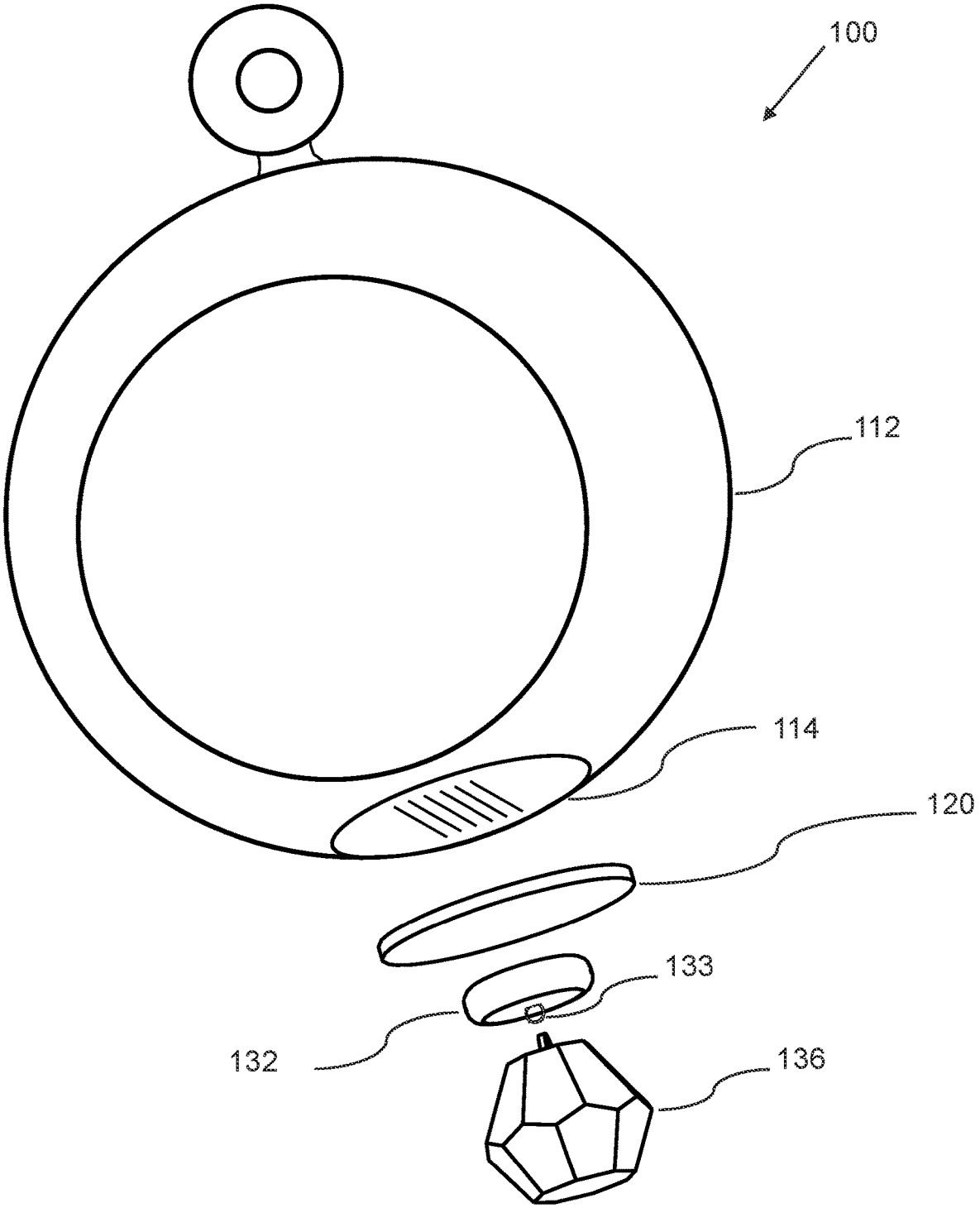
FIG. 2B is an exploded perspective view of a magnetic ornament system, according to an embodiment of the invention.
Figure 5:
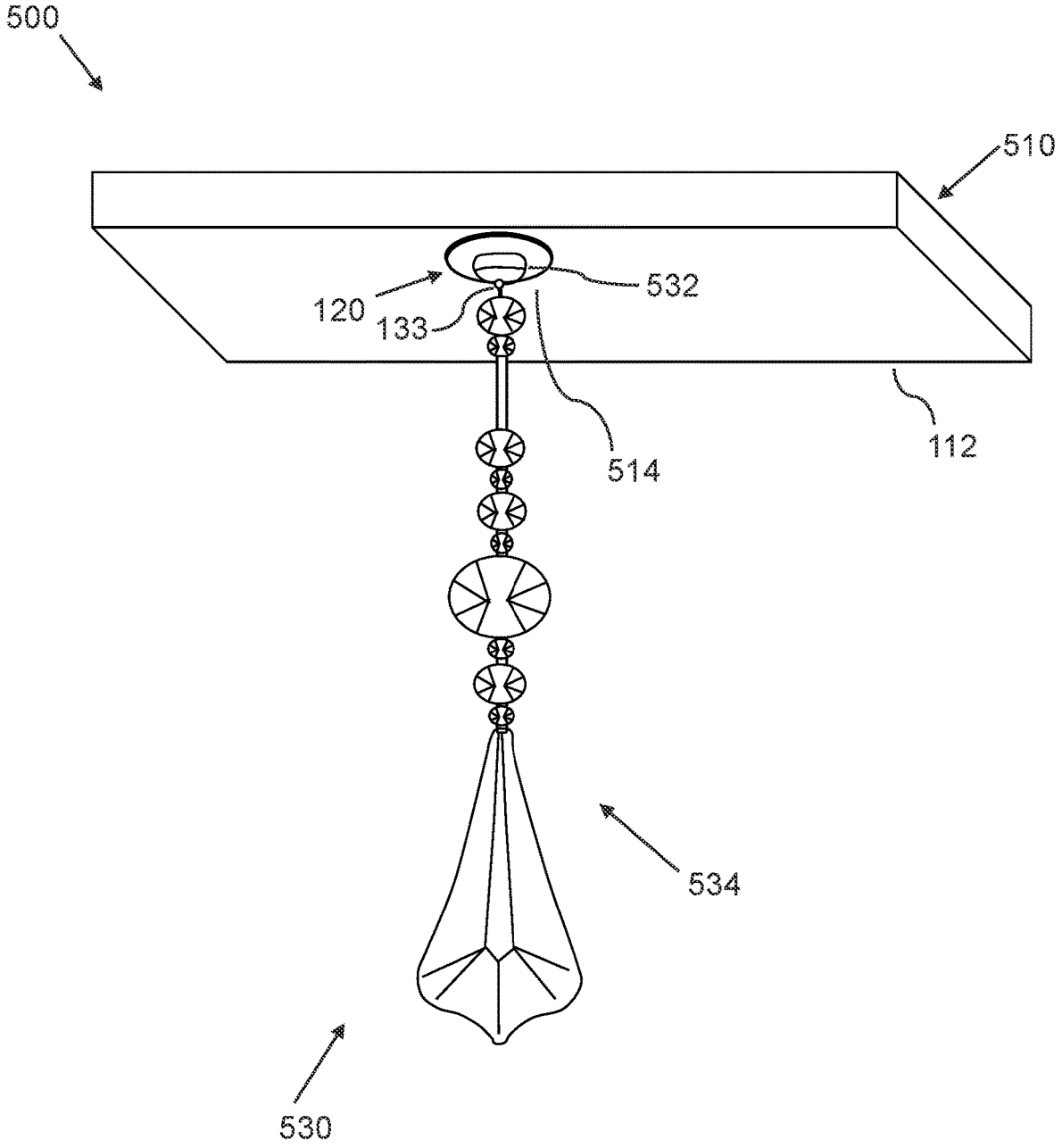
FIG. 5 is a perspective view of a magnetic ornament system, according to an embodiment of the invention.
Figure 6:
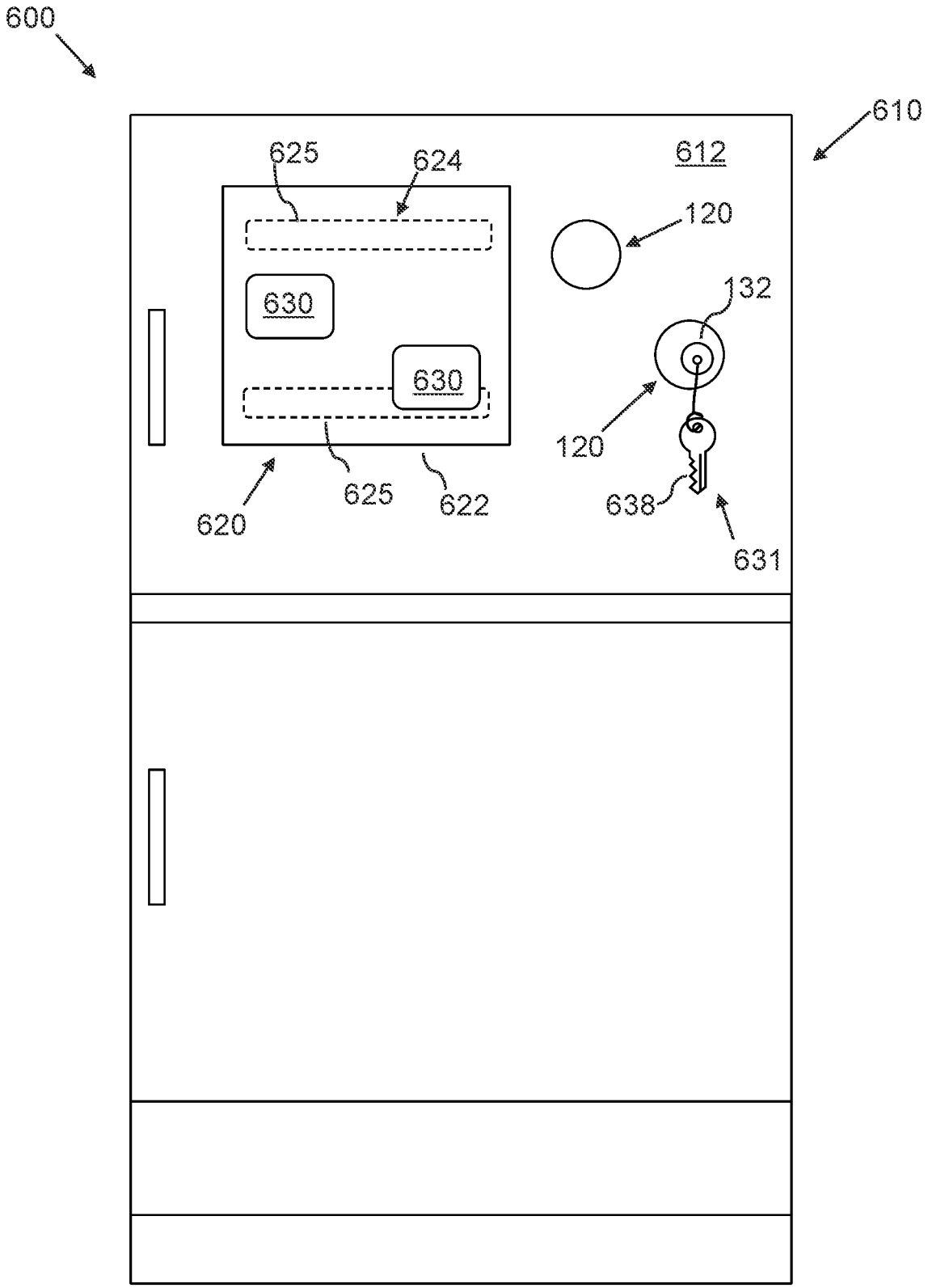
FIG. 6 is a front schematic view of a magnetic ornament system, according to an embodiment of the invention.
Figure 7:
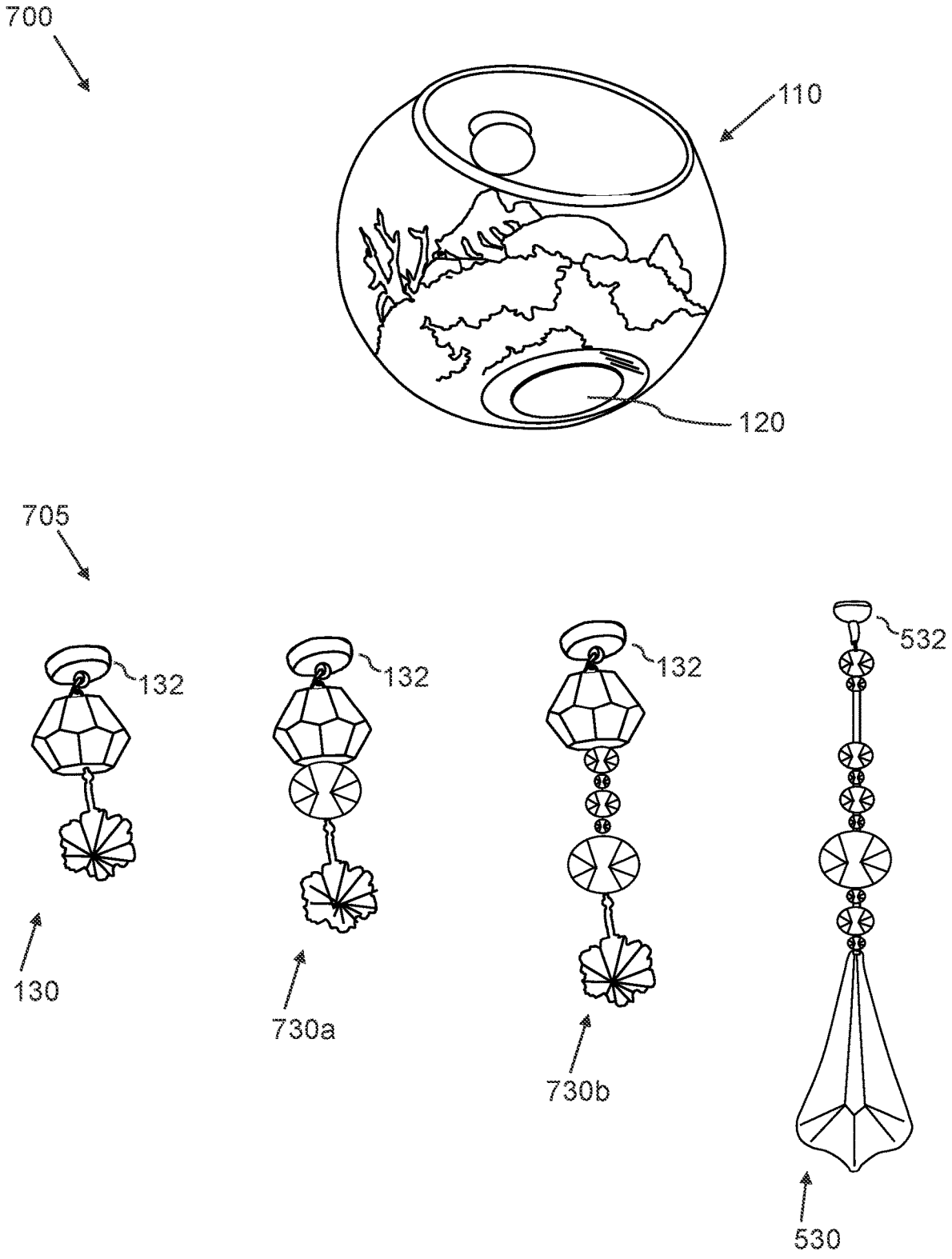
FIG. 7 is a perspective view of a magnetic ornament system, according to an embodiment of the invention.

In related embodiments, the mounting structure 110, 510 can for example be:

a) a glass ornament 110, such as a so-called hanging glass terrarium, as shown in FIG. 1;
b) a shelf 510, as shown in FIG. 5, such that a mounting surface of the shelf is on a bottom of the shelf, for example adjacent to an edge of the shelf;
c) a cabinet 610, as shown in FIG. 6, such that a mounting surface of the cabinet 610 can be on a front surface of a door of the cabinet 610;
d) a table, such that a mounting surface of the table is on a bottom of the table, for example towards an edge of the table; or
e) another structure, such as a window or window ledge, a ceiling, a bottom of a bird cage, a cake holder, etc.

In a related embodiment, the adhesive material 124 can be a structural adhesive, such that the magnetic plate 120 is permanently connectable to the mounting surface 114, 214 of the mounting structure 110.

In a related embodiment, the plate body 122 can be made of a ferromagnetic material, such as for example a magnetic stainless steel alloy, including a 316/316L steel alloy.

In another related embodiment, the plate body 122 can be made of a ferrimagnetic material, such as for example magnetic ferrous-ferric oxide or yttrium iron garnet.

In related embodiment, the plate body 122 can have various shapes, such as round, elliptical, rectangular, or adapted in a predetermined shape to fit a mounting area.

In a further related embodiment, as shown in FIG. 6, which shows a magnetic ornament system 600, which comprises a mounting structure 610, configured as a cabinet 610, wherein a plate body 622 of a rectangular magnetic plate 620 can for example be configured as a rectangular sheet, which can be detachably mounted on a non-magnetic wall or other surface, such as a front surface 612 of a cabinet door, such that the magnetic plate 620 can be used to attach magnetic structures which include a magnet, such as refrigerator magnets 630 that are commonly magnetically attached to a fridge, including magnetic advertisements and information pieces, thereby allowing attachment of refrigerator magnets 630 with attached ornamentation or graphical display to a non-magnetic surface. The magnetic plate 620 can further include an adhesive structure 624 (shown in dotted lines) on a back of the plate body 622, wherein the adhesive structure 624 can include at least one adhesive strip 625, which can be a detachable adhesive strip 625.

In a related embodiment, the magnetic ornament system 600 can further include at least one round magnetic plate 120, which are mounted on the mounting structure 610. FIG. 6, shows a magnetic structure 631, comprising a magnet 132 with an attached structure member 638, which is configured as a key; such that the magnetic structure 631 is attached to the magnetic plate 120 with the magnet 132.

In another related embodiment, the protective member 126 can be made of a protective film, such as for example a transparent plastic sheet made from polyethylene.

In yet another related embodiment, the connector member 133 can be a hoop hanger, snap connector, clasp, hook-and-loop fastener, pin, or other mechanical fastener.

Figure 2C:
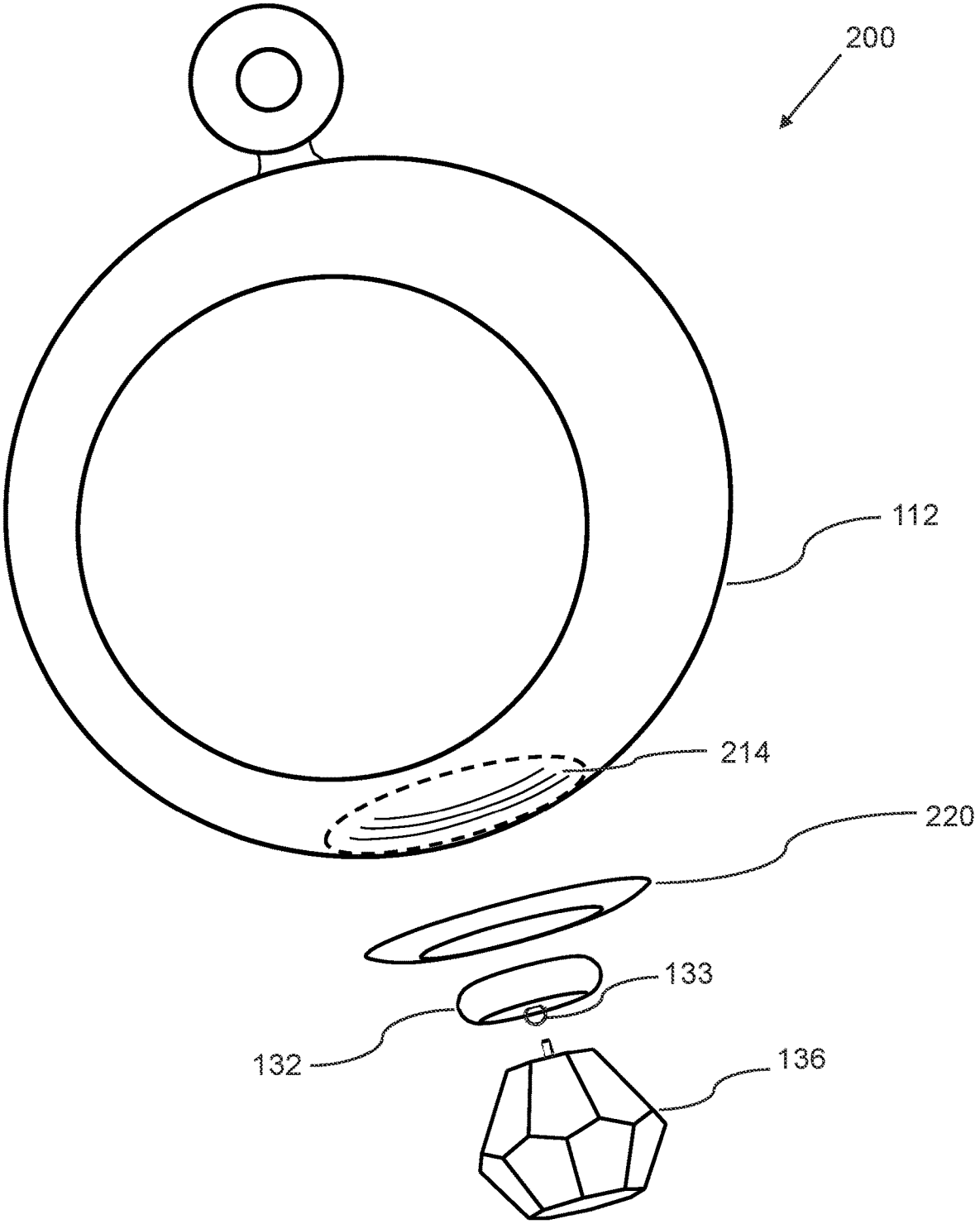
FIG. 2C is an exploded perspective view of a magnetic ornament system, according to an embodiment of the invention.
Figure 3A:
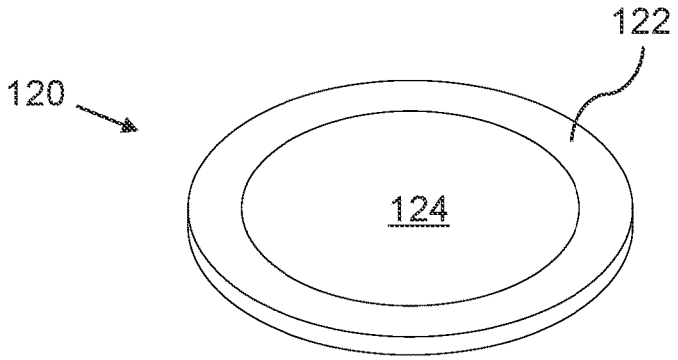
FIG. 3A is a top perspective view of a magnetic plate, according to an embodiment of the invention.
Figure 3B:
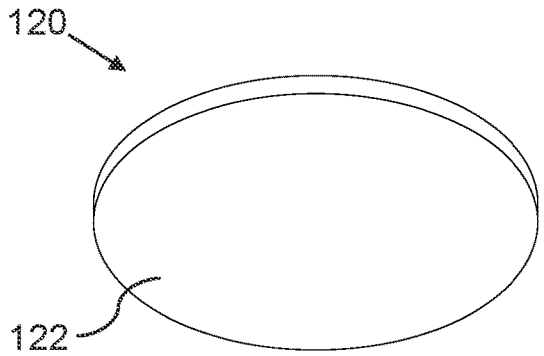
FIG. 3B is a bottom perspective view of a magnetic plate, according to an embodiment of the invention.
Figure 3C:
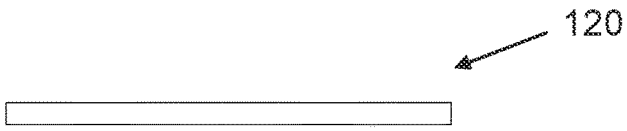
FIG. 3C is a front view of a magnetic plate, according to an embodiment of the invention.
Figure 4A:
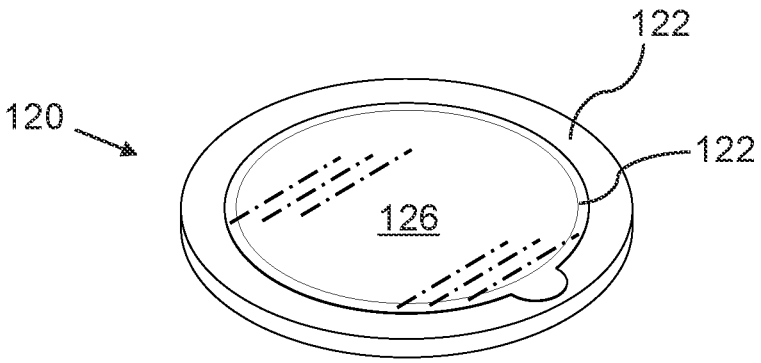
FIG. 4A is a top perspective view of a magnetic plate, according to an embodiment of the invention.
Figure 4B:
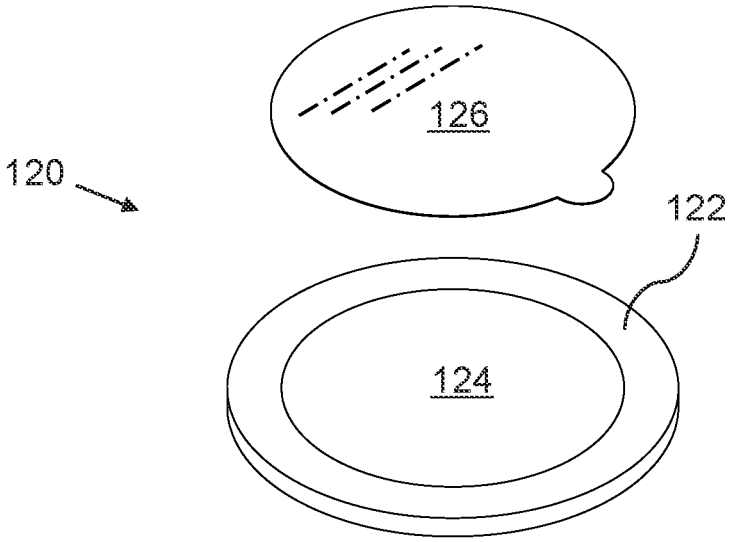
FIG. 4B is an exploded perspective view of a magnetic plate, according to an embodiment of the invention.

In still another related embodiment of a magnetic ornament system 200, as shown in FIG. 2C, the plate body 220 can be comprised of a thin, flexible sheet of ferromagnetic or ferrimagnetic material embedded between a more ductile or elastic material, such as for example plastic, rubber, or polyresin materials.

Thus, in a related embodiment of the magnetic ornament system 200, as shown in FIG. 2C, the mounting surface 214 can be configured with a non-flat curvature, wherein the plate body 220 can be flexible, such that the plate body 220 is configured to adapt and adhere to the non-flat curvature of the mounting surface 214 of the mounting structure 110.

In a related embodiment, a magnetic ornament system 700 can be configured as a kit, wherein the magnetic ornament system 700 can include:

a) a mounting structure 110, which can be configured as a glass ornament 110;

b) a magnetic plate 120 as shown in FIGS. 3A, 3B, 3C, 4A-4B, and 5, which can be permanently connected to the mounting structure 110 using a structural adhesive; and c) a plurality 705 of magnetic structures 130, 730*a*, 730*b*, 530, which can be magnetic ornaments 130, 730*a*, 730*b*, 530 which can each include:

i. a magnet 132, 532; and ii. a structure assembly 134, 534, 634, which can be an ornament assembly 134, 534 which can include at least one structure member 136, 138, 638, which can be at least one hanging ornament 136, 138 or a plurality of hanging ornaments 136, 138, wherein the top end of the structure assembly 134 can connect to the magnet 132, 532, via the connector member 133;

such that the magnetic plate 120 can be positioned to adhere to a mounting surface 114 of the mounting structure 110, using an adhesive material 124, such that the magnetic plate 120 is held in position by the adhesive material 124;

wherein the magnet is detachably connectable to the plate body of the magnetic plate;

such that each magnetic ornament 130, 730*a*, 730*b*, 530 in the plurality 705 of magnetic ornaments 130, 730*a*, 730*b*, 530 is detachably connectable to the magnetic plate.

In various related embodiments, a structure assembly 134, 534, 634, which can be an ornament assembly 134, 534, can be manufactured in a variety of designs and shapes, and can be made of glass, crystal, wood, metal, plastic, other suitable materials, and combinations thereof.

Here has thus been described a multitude of embodiments of the system for hanging magnetic ornaments, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A magnetic ornament system for hanging magnetic ornaments, comprising:

a) a mounting structure, which comprises a mounting surface;

b) a magnetic plate, comprising:

a plate body, which is magnetic; and an adhesive material;

wherein the adhesive material is positioned on a top surface of the magnetic plate; and c) a magnetic ornament, comprising:

a magnet;

a connector member, which is connected to the magnet; and an ornament assembly, which comprises at least one hanging ornament;

wherein the connector member is connected to a top end of the ornament assembly;

such that the magnetic plate is connectable to the mounting surface of the mounting structure, such that the magnetic plate is held in position by the adhesive material;

such that the magnet of the magnetic ornament is detachably connectable to the plate body of the magnetic plate, whereby the magnetic ornament is detachably connectable to the mounting structure.

2. The magnetic ornament system of claim 1, wherein the plate body is made from a ferromagnetic material.

3. The magnetic ornament system of claim 2, wherein the ferromagnetic material is a magnetic stainless steel alloy.

4. The magnetic ornament system of claim 1, wherein the plate body is made from a ferrimagnetic material.

5. The magnetic ornament system of claim 1, wherein the mounting surface is configured with a non-flat curvature, wherein the plate body is flexible, such that the plate body is configured to adhere to the non-flat curvature of the mounting surface of the mounting structure.

6. The magnetic ornament system of claim 1, wherein the adhesive material is a pressure sensitive adhesive, such that the magnetic plate is detachably connectable to the mounting surface of the mounting structure.

7. The magnetic ornament system of claim 1, wherein the adhesive material is a structural adhesive, such that the magnetic plate is permanently connectable to the mounting surface of the mounting structure.

8. The magnetic ornament system of claim 1, wherein the magnet is a ceramic magnet made from strontium ferrite.

9. The magnetic ornament system of claim 1, wherein the magnetic plate further comprises a protective member;

wherein the protective member is detachably positioned on a top surface of the adhesive material, such that the protective member is configured to cover the adhesive material.

10. The magnetic ornament system of claim 9, wherein the protective member is a transparent plastic sheet.

11. A magnetic ornament system for hanging magnetic ornaments, comprising:

a) a magnetic plate, comprising:

a plate body, which is magnetic; and an adhesive material;

wherein the adhesive material is positioned on a top surface of the magnetic plate; and b) at least one magnetic ornament, comprising:

a magnet; and an ornament assembly, which comprises at least one ornament;

wherein the magnet is connected to a top end of the ornament assembly;

such that the magnetic plate is configured to be connectable to a mounting surface of a mounting structure, such that the magnetic plate is held in position by the adhesive material;

such that the magnet of the at least one magnetic ornament is detachably connectable to the plate body of the magnetic plate, whereby the magnetic ornament is detachably connectable to the mounting structure.

12. The magnetic ornament system of claim 11, wherein the mounting surface is configured with a non-flat curvature, wherein the plate body is flexible, such that the plate body is configured to adhere to the non-flat curvature of the mounting surface of the mounting structure.

13. The magnetic ornament system of claim 11, wherein the adhesive material is a pressure sensitive adhesive, such that the magnetic plate is detachably connectable to the mounting surface of the mounting structure.

14. The magnetic ornament system of claim 11, wherein the adhesive material is a structural adhesive, such that the magnetic plate is permanently connectable to the mounting surface of the mounting structure.

15. The magnetic ornament system of claim 11, wherein the magnetic plate further comprises a protective member;

wherein the protective member is detachably positioned on a top surface of the adhesive material, such that the protective member is configured to cover the adhesive material.

16. The magnetic ornament system of claim 11, wherein the adhesive material is a structural adhesive, such that the magnetic plate is permanently connected to the mounting surface of the mounting structure; wherein the at least one magnetic ornament comprises:

a plurality of magnetic ornaments;

such that each magnetic ornament in the plurality of magnetic ornaments, is detachably connectable to the magnetic plate.

17. A magnetic ornament system for hanging magnetic structures, comprising:

a magnetic plate, comprising:

a plate body, which is magnetic; and an adhesive material;

wherein the adhesive material is positioned on a top surface of the magnetic plate; and such that the magnetic plate is configured to be connectable to a mounting surface of a mounting structure, such that the magnetic plate is held in position by the adhesive material;

such that a magnet is detachably connectable to the plate body of the magnetic plate, whereby the magnet is detachably connectable to the mounting structure, when the magnetic plate is connected to the mounting surface.

18. The magnetic ornament system of claim 17, wherein the adhesive material is a pressure sensitive adhesive, such that the magnetic plate is detachably connectable to the mounting surface of the mounting structure.

19. The magnetic ornament system of claim 17, wherein the adhesive material is a structural adhesive, such that the magnetic plate is permanently connectable to the mounting surface of the mounting structure.

20. The magnetic ornament system of claim 17, wherein the magnetic plate further comprises:

a protective member;

wherein the protective member is detachably positioned on a top surface of the adhesive material, such that the protective member is configured to cover the adhesive material.

21. The magnetic ornament system of claim 17, further comprising:

a magnetic structure, comprising:

the magnet; and a structure assembly, which comprises at least one structure member;

wherein the structure assembly is connected to the magnet.

* * * * *